US010467877B1

(12) United States Patent
Elyakim et al.

(10) Patent No.: US 10,467,877 B1
(45) Date of Patent: Nov. 5, 2019

(54) MONITOR AND A METHOD FOR MONITORING A BABY IN A VEHICLE

(71) Applicant: DSP Group Ltd., Herzliya (IL)

(72) Inventors: Ofer Elyakim, Tel Aviv (IL); Lior Blanka, Rosh Haayin (IL)

(73) Assignee: DSP GROUP LTD., Herzlita (IL)

( * ) Notice: Subject to any disclaimer, the term of this patent is extended or adjusted under 35 U.S.C. 154(b) by 0 days.

(21) Appl. No.: 15/993,650

(22) Filed: May 31, 2018

Related U.S. Application Data

(60) Provisional application No. 62/530,207, filed on Jul. 9, 2017, provisional application No. 62/530,226, filed on Jul. 9, 2017.

(51) Int. Cl.
*G08B 21/02* (2006.01)

(52) U.S. Cl.
CPC ..... *G08B 21/0208* (2013.01); *G08B 21/0202* (2013.01); *G08B 21/023* (2013.01); *G08B 21/028* (2013.01); *G08B 21/0277* (2013.01)

(58) Field of Classification Search
CPC ..... G08B 21/02; G08B 21/0202; G08B 21/0205; G08B 21/0208; G08B 21/0227; G08B 21/023; G08B 21/0233; G08B 21/0236; G08B 21/0277; G08B 21/028; G08B 21/0283; G08B 21/0294; G06F 9/54; G06F 9/546; H04W 4/00; H04W 48/04; B60N 2/28; B60N 2/2842; B60N 2/2884; B60R 1/00
See application file for complete search history.

(56) References Cited

U.S. PATENT DOCUMENTS

| | | | | |
|---|---|---|---|---|
| 8,768,292 | B2 * | 7/2014 | Welch | B60N 2/002 455/404.2 |
| 9,741,224 | B1 * | 8/2017 | Singh | H04W 4/14 |
| 10,268,530 | B2 * | 4/2019 | Breaux | G06F 9/546 |
| 2015/0274036 | A1 * | 10/2015 | Arad | B60N 2/002 340/573.1 |
| 2016/0347213 | A1 * | 12/2016 | Pretta | F21K 9/23 |

* cited by examiner

*Primary Examiner* — Van T Trieu
(74) *Attorney, Agent, or Firm* — Reches Patents

(57) ABSTRACT

A method for monitoring, the method may include constantly operating, within one or more sensing periods, a microphone and a trigger sensor of a monitor that is installed in a vehicle, even when an processor of the monitor is asleep; receiving by the microphone, while the processor is asleep, initial audio signals; converting the initial audio signals to initial electrical signals representative of the initial audio signals; searching, by the trigger sensor and in the initial electrical signals, for a voice trigger that is related to a sound made by the baby; when finding the voice trigger then awakening the processor; searching, by the processor, for the sound made by the baby in at least one out of the initial audio signals, and following audio signals. When finding the sound made by the baby then executing a baby in vehicle response.

22 Claims, 11 Drawing Sheets

105

MONITOR AND A METHOD FOR MONITORING A BABY IN A VEHICLE

CROSS REFERENCE

Figure 1:
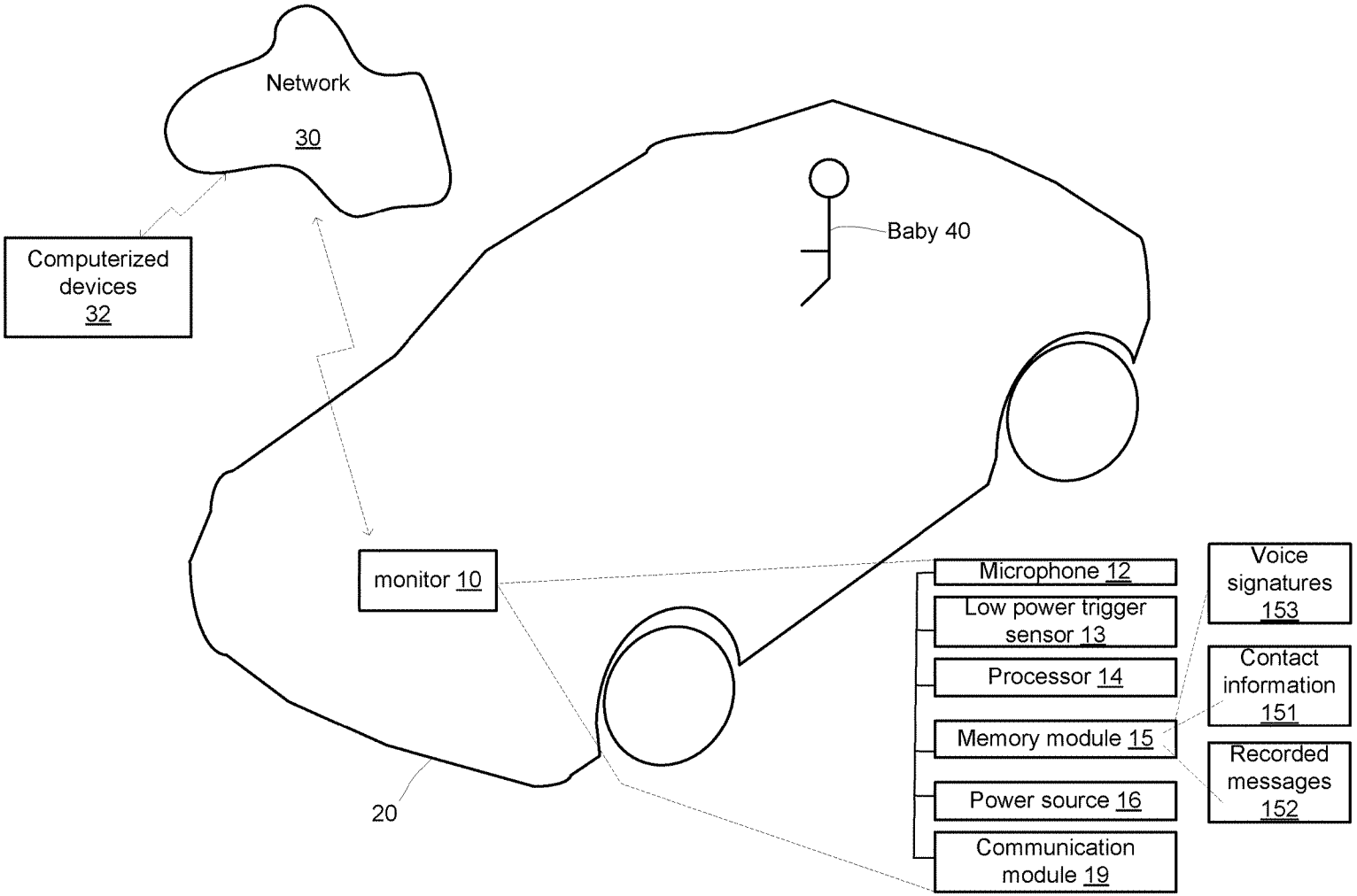

This application claims priority from U.S. provisional patents Ser. No. 62/530,226 filing date Jun. 9 2017, which is incorporated herein by reference.

BACKGROUND OF THE INVENTION

There is a growing need to generate an alert when a baby is left in a vehicle, and/or to detect other events related to the vehicle.

SUMMARY

There may be provided a method for monitoring, the method may include constantly operating, within one or more sensing periods, a microphone and a trigger sensor of a monitor that may be installed in a vehicle, even when an processor of the monitor may be asleep; receiving by the microphone, while the processor may be asleep, initial audio signals; converting, by the microphone, the initial audio signals to initial electrical signals representative of the initial audio signals; receiving, by the trigger sensor, the initial electrical signals representative of the initial audio signals; searching, by the trigger sensor and in the initial electrical signals, for a voice trigger that may be related to a sound made by the baby; when finding the voice trigger then awakening the processor; searching, by the processor, for the sound made by the baby in at least one out of (a) the initial audio signals, and (b) following audio signals sensed by the microphone after the awakening of the processor; when finding the sound made by the baby then executing a baby in vehicle response.

The power consumption of the trigger sensor may be lower than a power consumption of the processor when the processer may be awake. The ratio between these power consumptions may be, for example, between 1:10 till 1:1000, and the like.

The preforming of the baby in vehicle response may include generating and transmitting outside of the vehicle one or more messages indicative of the sensing the sound made by the baby.

At least one of the one or more messages may include an audio recording of the sound made by the baby that was sensed by the microphone.

At least one of the one or more messages may include an audio recording of the sound made by the baby that was sensed by the microphone after the awakening of the processor.

At least one of the one or more messages may include an audio recording of the sound made by the baby that was sensed by the microphone, starting before the awakening of the processor.

The method may include storing or retrieving contact information for contacting a computerized device located outside the vehicle, and sending at least one of the one or more messages using the contact information.

The method may include sending at least one of the one or more messages using a predefined list of receivers that may be stored in a vehicle database.

The method may include retrieving from a vehicle system, contact information for contacting a computerized device located outside the vehicle, and requesting a communication component of the vehicle to send at least one of the one or more messages using the contact information.

The preforming of the baby in vehicle response may include playing, by a speaker, an audio recording of the sound made by the baby that was sensed by the microphone.

The preforming of the baby in vehicle response may include instructing or requesting, by the processor, a speaker of the vehicle to play an audio recording of the sound made by the baby that was sensed by the microphone.

The method may include putting to sleep the processor when failing to find the sound sound made by the baby.

The preforming of the baby in vehicle response may include unlocking the vehicle.

The preforming of the baby in vehicle response may include performing at least one out of activating hazard lights of the vehicle and generating generate hazard noises by the vehicle.

The preforming of the baby in vehicle response may include broadcasting a baby in vehicle message.

The at least one sensing period of the one or more sensing periods overlap a shut down period of the vehicle during which the vehicle may be shut down.

The at least one sensing period of the one or more sensing periods overlap a turn on period of the vehicle during which the vehicle may be turned on.

The method may include receiving, by the monitor and from a vehicle computer status information about a status of the vehicle; and determining, based on the status of the vehicle, whether to start a sensing period of the one or more sensing periods.

The method may include searching, by the trigger sensor and in the initial electrical signals, for another voice trigger that may be related to a burglary attempt; when finding the other voice trigger then awakening the processor; searching, by the processor, for a sound that may be related to the burglary attempt in at least one out of the initial audio signals, and the following audio signals; when finding the sound that may be related to the burglary attempt then performing a burglary attempt response.

The burglary attempt response may include locking the vehicle when finding that sound.

The burglary attempt response may include generating and transmitting outside of the vehicle one or more messages indicative of the burglary attempt.

There may be provided a non-transitory computer readable medium that stores instructions that once executed by a monitor that may be installed in a vehicle, cause the monitor to execute the steps of: constantly operating, within one or more sensing periods, a microphone and a trigger sensor of the monitor, even when a processor of the monitor may be asleep; wherein a power consumption of the trigger sensor may be lower than a power consumption of the processor when the other processer may be awake; receiving by the microphone, while the processor may be asleep, initial audio signals; converting, by the microphone, the initial audio signals to initial electrical signals representative of the initial audio signals; receiving, by the trigger sensor, the initial electrical signals representative of the initial audio signals; searching, by the trigger sensor and in the initial electrical signals, for a voice trigger that may be related to a sound made by the baby; when finding the voice trigger then awakening the processor; searching, by the processor, for the sound made by the baby in at least one out of (a) the initial audio signals, and (b) following audio signals sensed by the microphone after the awakening of the processor; and when finding the sound made by the baby then executing a baby in vehicle response.

The non-transitory computer readable medium may be a hardware memory unit, a disk, a compact disk, a diskette, and the like.

There may be provided a monitor that may include a processor, a microphone and a trigger sensor; wherein the microphone and the trigger sensor may be configured to constantly operate, within one or more sensing periods, even when the processor of the monitor may be asleep; wherein a power consumption of the trigger sensor may be lower than a power consumption of the processor when the other processer may be awake; wherein the microphone may be configured to (i) receive, while the processor may be asleep, initial audio signals; and (ii) convert the initial audio signals to initial electrical signals representative of the initial audio signals; wherein the trigger sensor may be configured to (i) receive the initial electrical signals representative of the initial audio signals; (ii) search in the initial electrical signals, for a voice trigger that may be related to a sound made by the baby; and (iii) participate in awakening the processor when finding the voice trigger; wherein the processor may be configured to (i) search for the sound made by the baby in at least one out of (a) the initial audio signals, and (b) following audio signals sensed by the microphone after the awakening of the processor; and (ii) assist in executing a baby in vehicle response, when finding the sound of the cry of the baby.

BRIEF DESCRIPTION OF THE INVENTION

Figure 2:
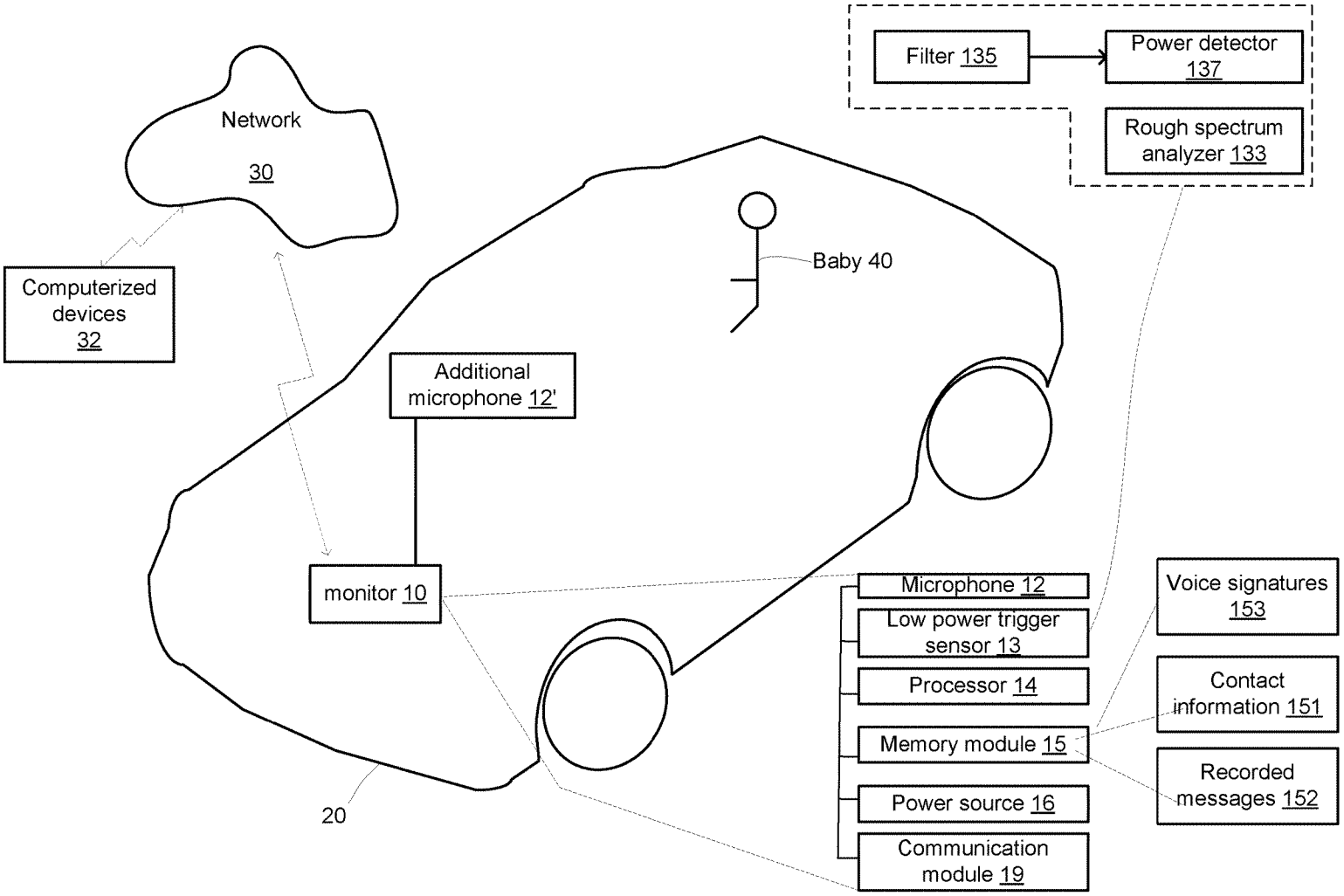
Figure 3:
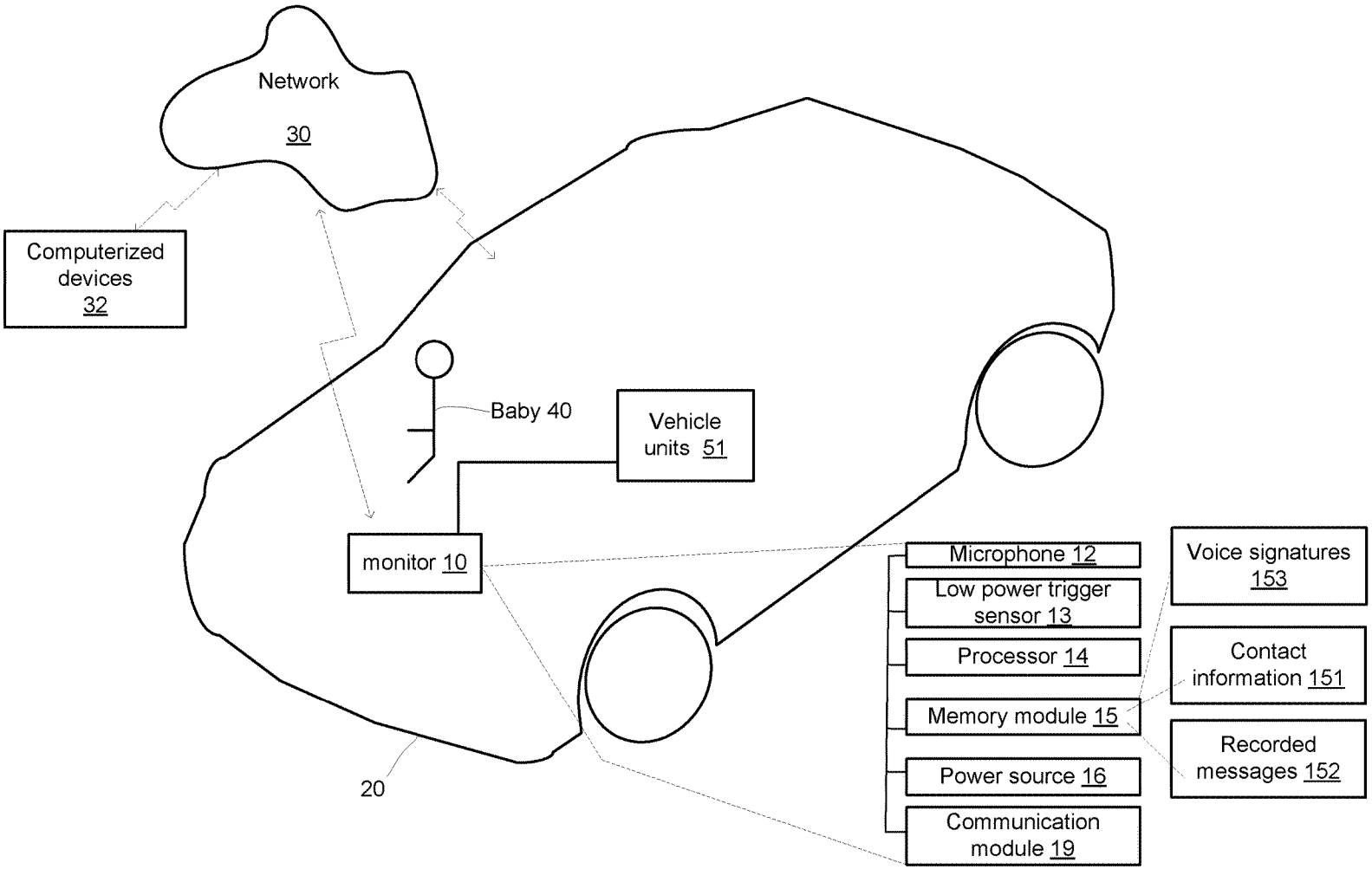
Figure 4:
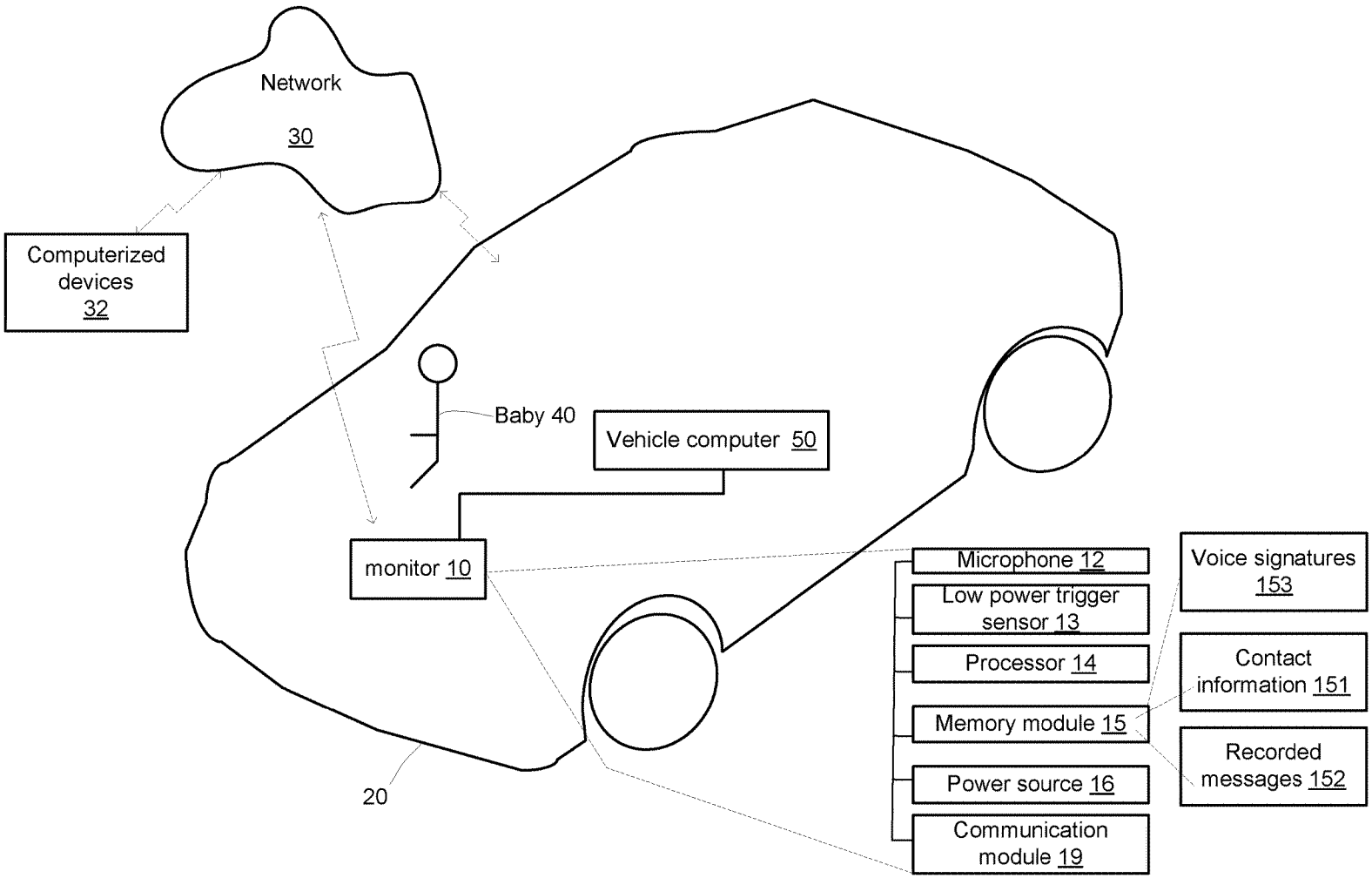
Figure 5:
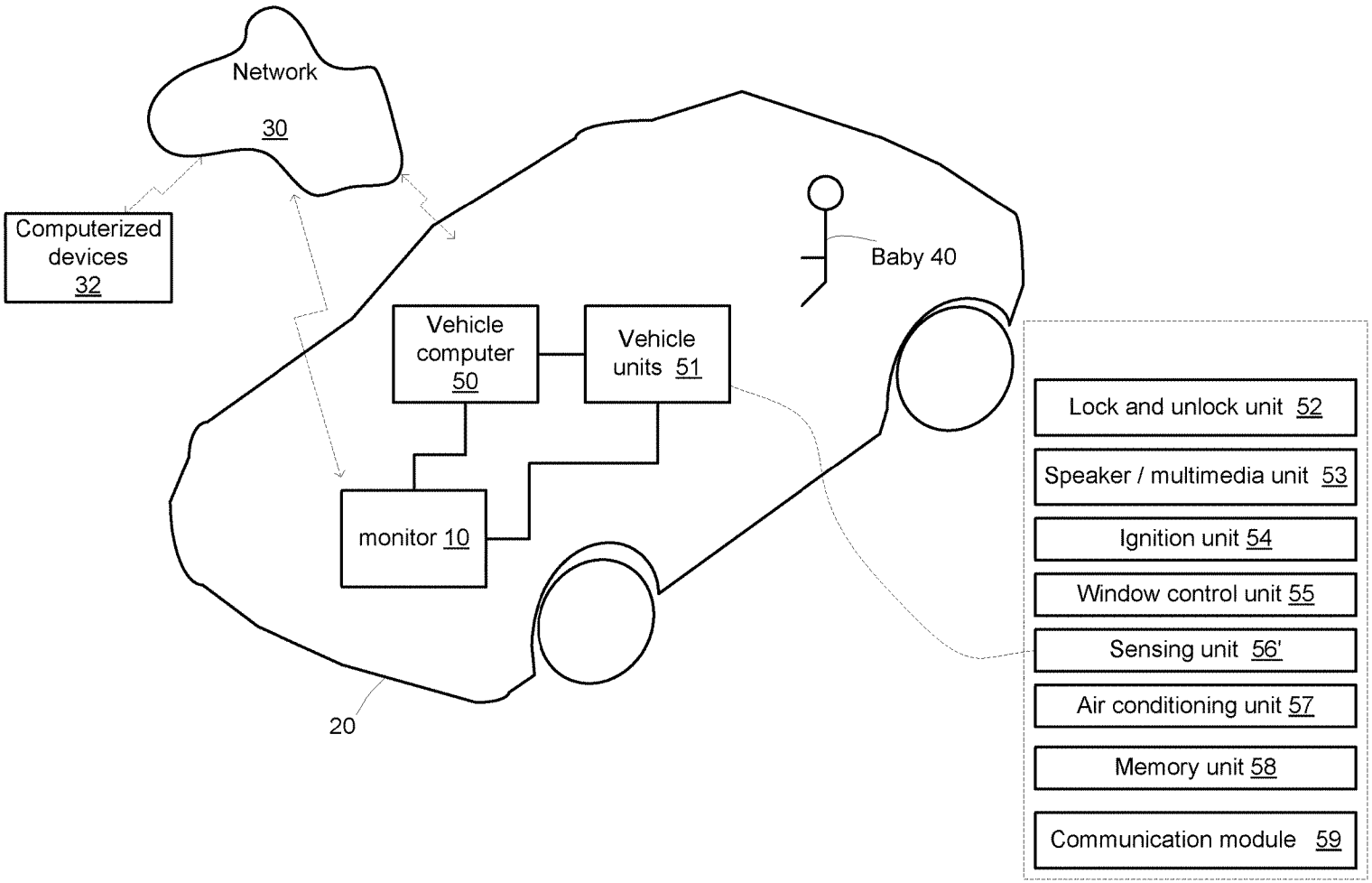
Figure 6:
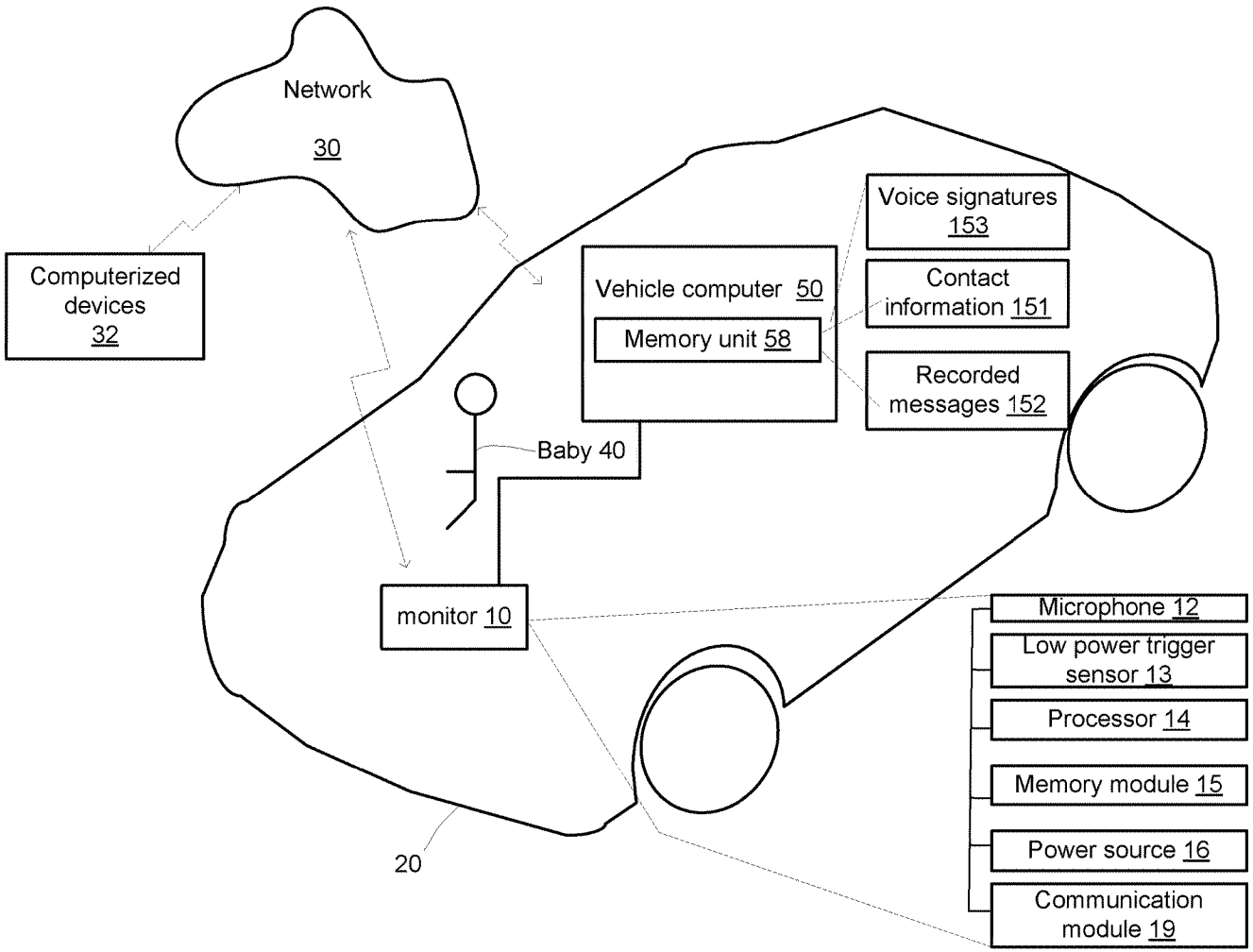
Figure 7:
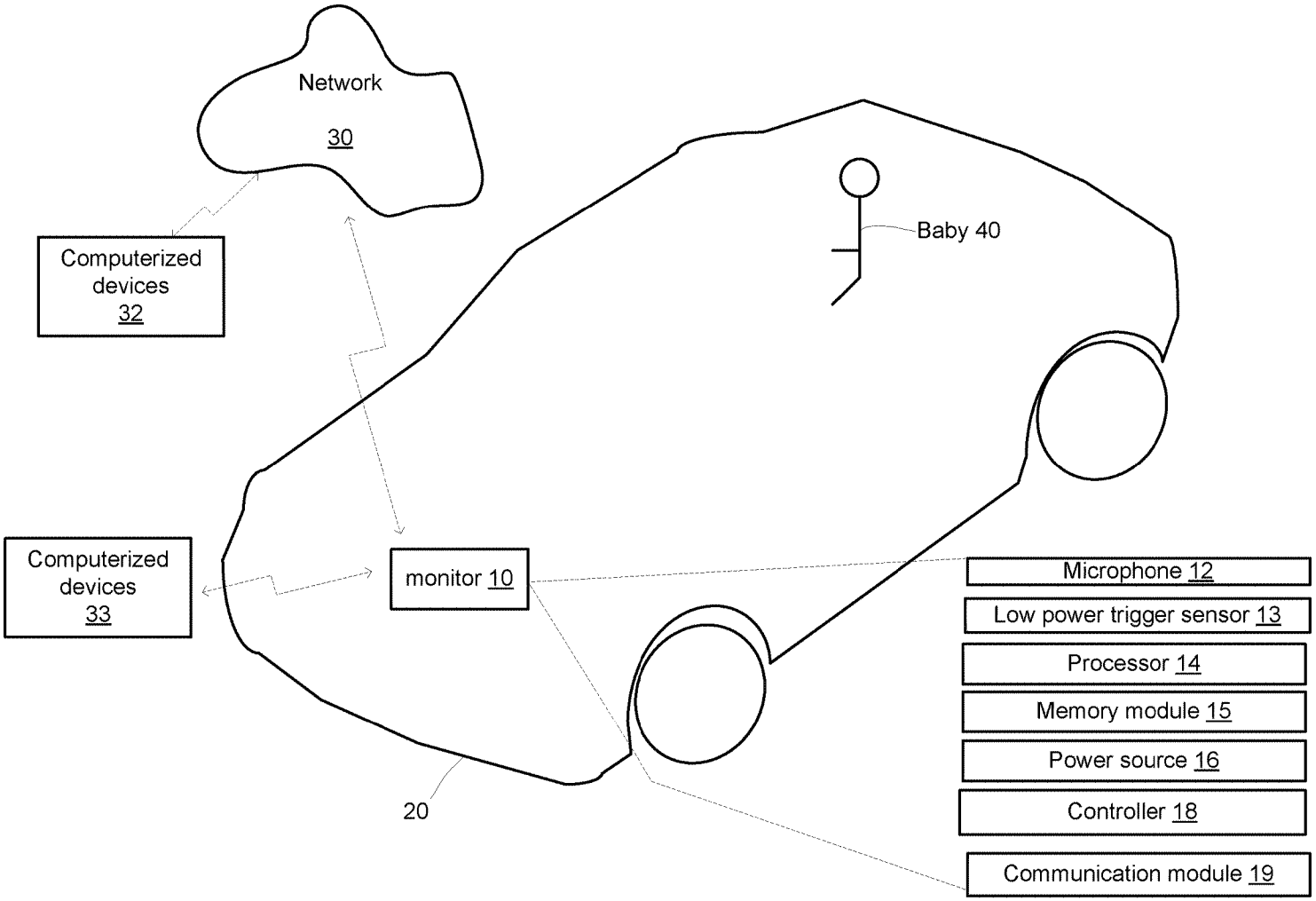
Figure 8:
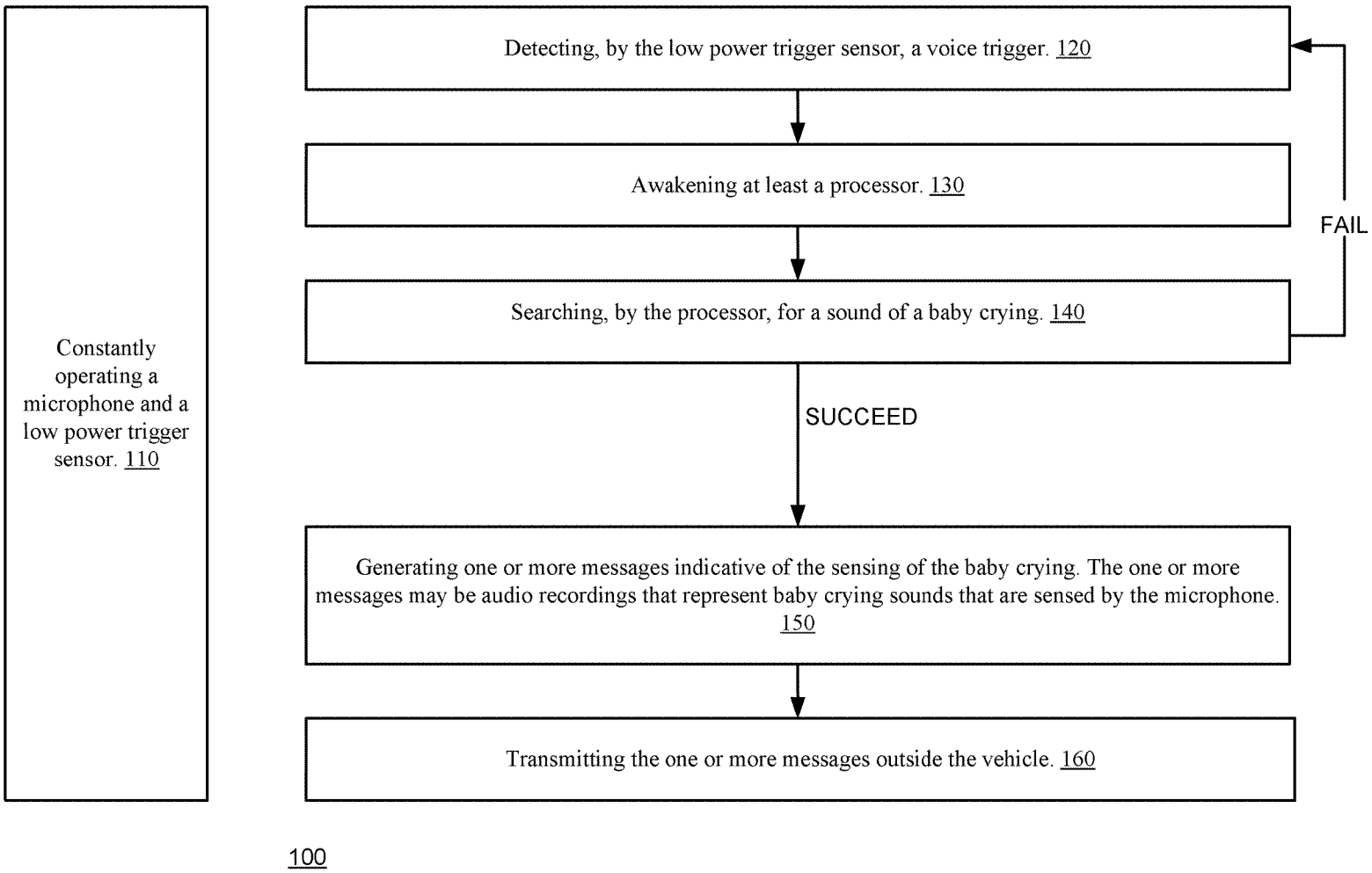
Figure 9:
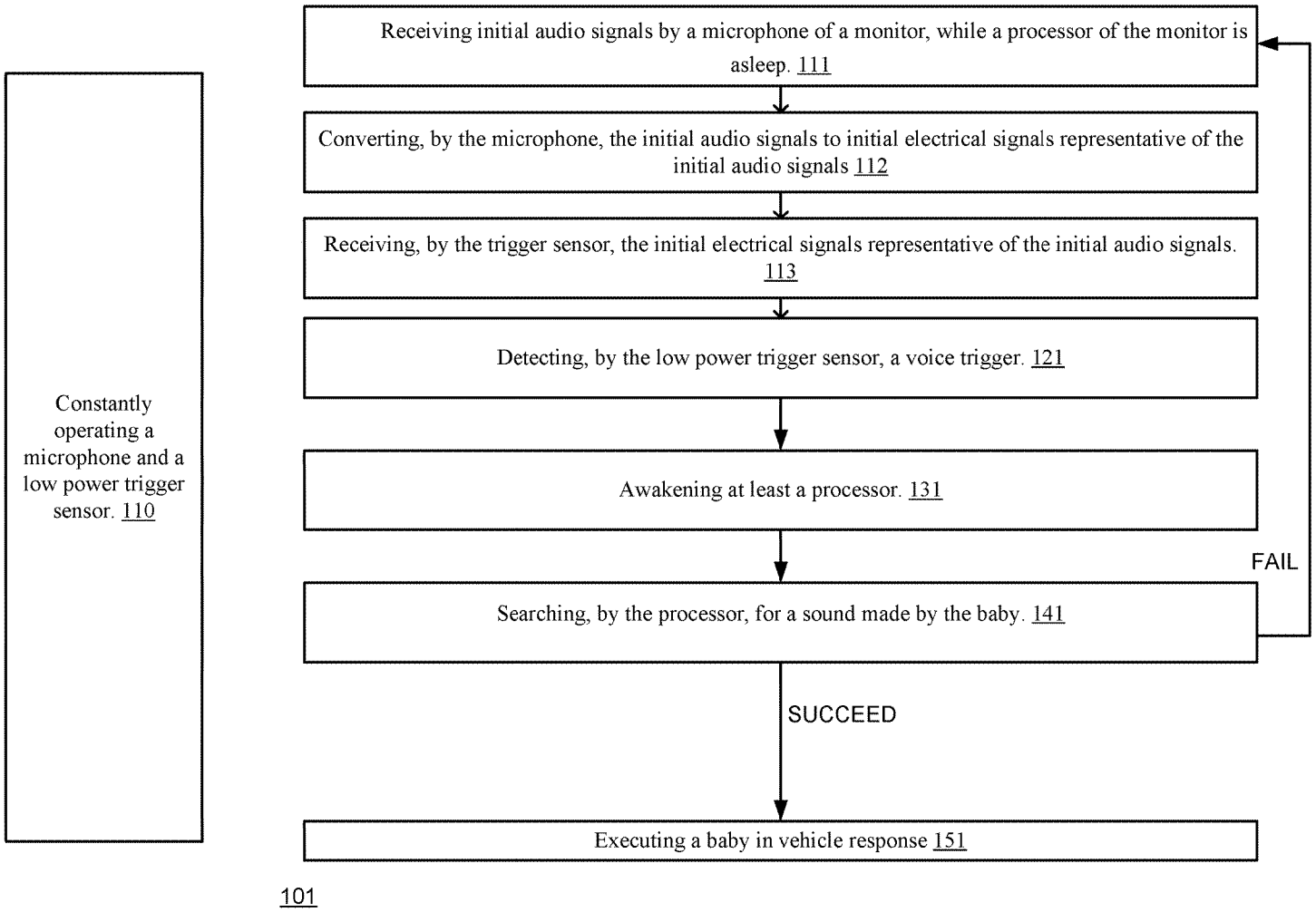
Figure 10:
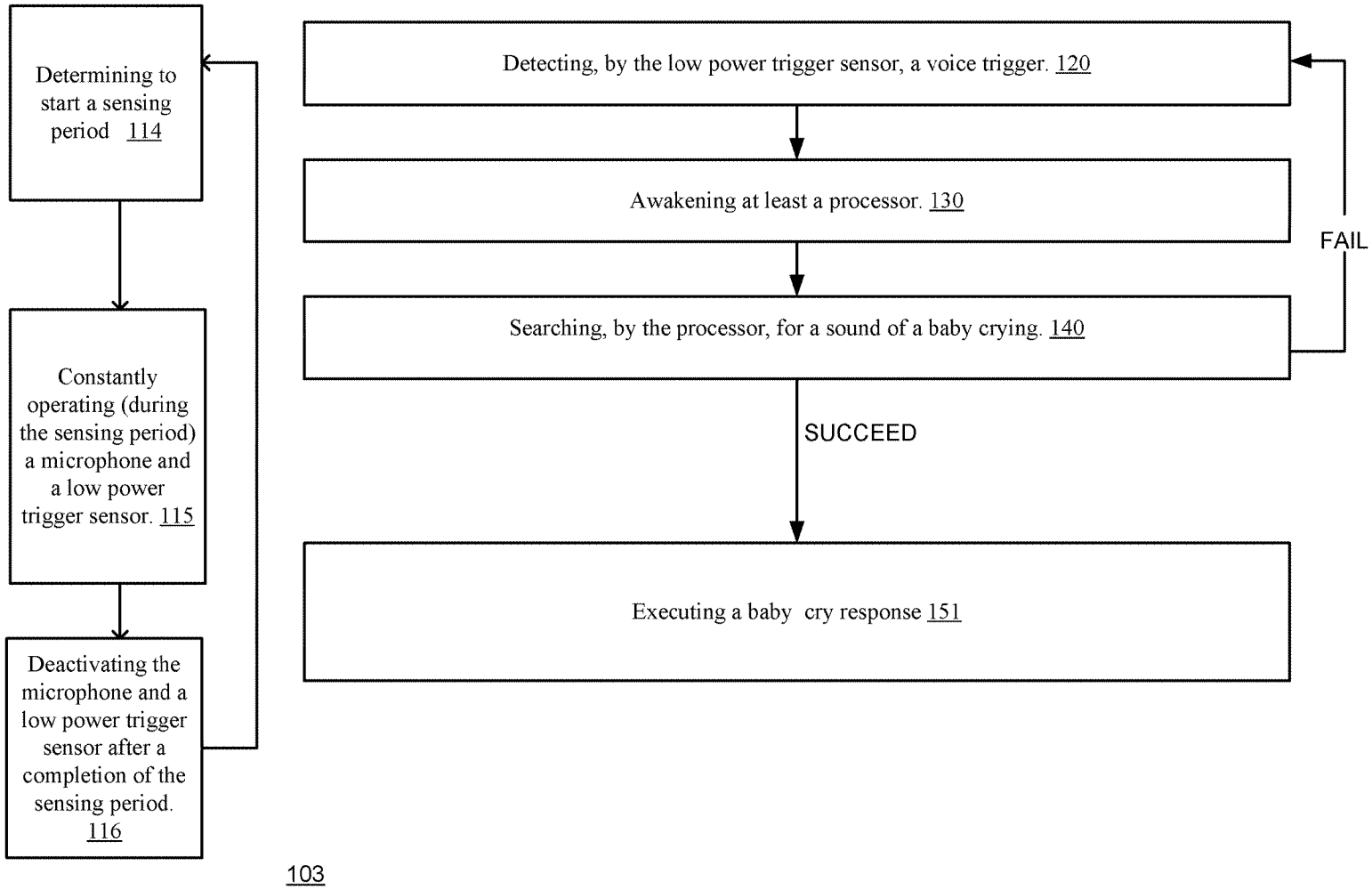
Figure 11:
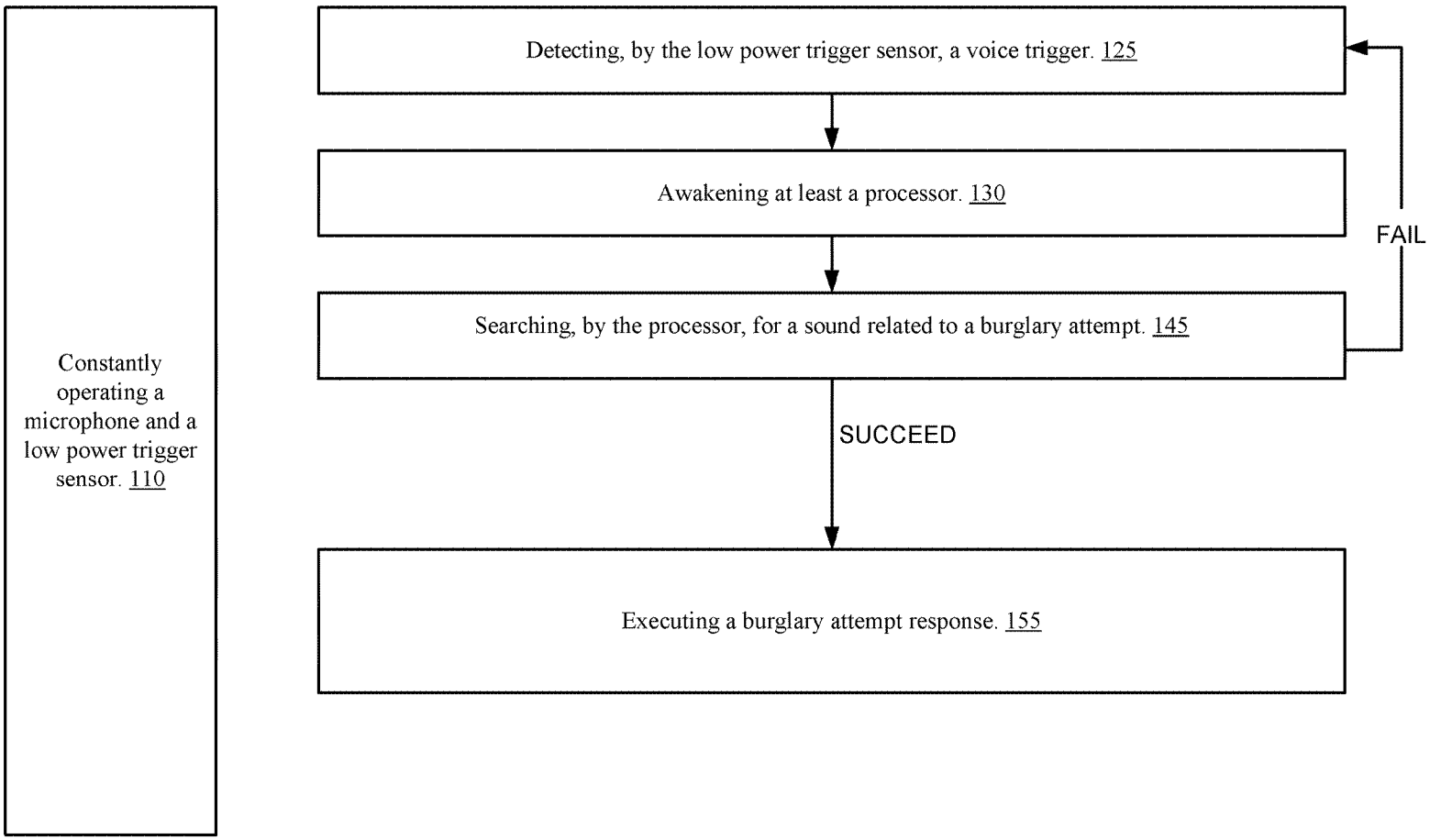

The present invention will be understood and appreciated more fully from the following detailed description taken in conjunction with the drawings in which:

FIG. 1 is an example of a vehicle, a baby and a device;
FIG. 2 is an example of a vehicle, a baby and a device;
FIG. 3 is an example of a vehicle, a baby and a device;
FIG. 4 is an example of a vehicle, a baby and a device;
FIG. 5 is an example of a vehicle, a baby and a device;
FIG. 6 is an example of a vehicle, a baby and a device;
FIG. 7 is an example of a vehicle, a baby and a device;
FIG. 8 is an example of a method;
FIG. 9 is an example of a method;
FIG. 10 is an example of a method; and
FIG. 11 is an example of a method.

DETAILED DESCRIPTION OF THE INVENTION

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

In the following specification, there will be provides specific examples of embodiments. It will, however, be evident that various modifications and changes may be made therein without departing from the broader spirit and scope of the invention as set forth in the appended claims.

The term "constantly" means uninterrupted and/or at a sampling rate—that may exceed once a second.

There is a provided a monitor and a method for detecting a presence of a baby in a vehicle.

The presence of the baby is detected by sensing a sound made by a baby that is located within a vehicle.

The sound made by the baby may be a crying sound or a another sound (for example any form of speech) sounded by a baby. For simplicity of explanation it is assumed that the sound made by the baby is a crying of a baby.

Some examples of a monitor 10 are illustrated in FIGS. 1-7.

Referring to FIG. 1—the monitor 10 may be installed in a vehicle and may constantly search for a sound trigger. The search may be executed all the time or during one or more sensing periods.

A sound trigger may be detected by low power trigger sensor 13 that may be "always on", and may be fed by microphone 12. The low power trigger sensor is also referred to as trigger sensor. The low power trigger sensor may have the resources to perform speech recognition or may not have the resources required to perform speech recognition.

The trigger sensor is a "low power" trigger sensor—because its power consumption is below the power consumption of the processor—when the processor is active and not asleep.

The sound trigger may be a sound that may be indicative of a sound made by a baby. The sound trigger may be of at least a predefined intensity, a sound of certain frequencies of at least a predefined frequency, and the like.

Once a sound trigger is detected the low power trigger sensor 13 may generate an indication, an alert, or a command that causes other components of the monitor to awake.

For example—a processor 14 that was in sleep mode may be awakened and may perform the task of searching for a sound of a baby crying. Yet for another example—communication module 19, and memory module 15 may be awakened.

After the monitor successfully outputs a message regarding the presence of a baby in the vehicle—the awakened components may or may not return to operate in a sleep mode—a low power mode and even a shut down mode.

The processor 14 may search for a fit between the sensed sounds and previously stored voice signatures that are indicative of a baby crying sound.

Additionally or alternatively, the processor 14 may perform any process for detecting a baby crying sound. The process may be based on a training process in which the crying baby is recorded. Alternatively—the process may be a training-less process.

The processor 14 also be configured to generate messages such as recorded massages 152 that may include audio recordings that represent baby crying sounds that are sensed by microphone 12—or were acquired by any other manner—from a certain baby, from any other baby—or generated in an artificial manner.

Any other messages (audio, video, text, audiovisual, and the like) may be generated in addition to or instead the recorded messages.

One or more of the recorded messages 152 may be transmitted using communication module 19.

The one or more recorded messages may be associated with contact information of computerized devices 32 that may be located outside the vehicle. The computerized devices may include communication devices such as mobile phones of a driver of the vehicle and/or mobile phones of other persons—including mobile phones of contact persons of the driver, the police, or other emergency services.

The contact information may include phone numbers, email addresses, social network nicknames or any other information required for delivering the recorded messages (or any other message) to the computerized devices of multiple people.

Communication module 19 may be a short-range communication module, a long-range communication module, a wireless communication module, a cellular communication module, a satellite communication module and the like.

Communication module 19 may communicate with network 30 that may be at least partially located outside the vehicle 20.

Once a user of any of the computerized devices 32 receives the recorded message that user may assist in preventing further damage to the baby—for example by opening the vehicle and/or removing the baby from the vehicle and/or contacting emergency services.

The processor and the low-power trigger sensor 13 may be a combination of a Vesper VM1010 wake-on-sound piezoelectric MEMS microphone with a DSP Group DBMD4 ultra-low-power, always-on voice and audio processor. Other chips and/or components may be used.

It should be noted that the monitor may be activated any time, may be activated only when the vehicle is turned off, and the like. The monitor 10 may sense that the vehicle is turned off by communicating with the vehicle computer (denoted 50 in FIG. 4) or by any other manner.

The monitor 10 and/or any component of the monitor may be located at any location within the vehicle. The monitor may monitor one or more babies that are located anywhere in the vehicle.

The monitor 10 may include multiple sensors and/or may be fed by multiple sensors.

FIG. 2 illustrates an additional microphone 12' that is coupled to monitor 10. Any other sensors (pressure, thermal, and the like) may be used.

The additional microphone 12' may be used to sense signals in addition to microphone 12 or instead of microphone 12.

FIG. 2 illustrates two examples of the low trigger sensor:

a. A rough spectrum analyzer 133 that is configured to sense one or more spectral components that are indicative in a sound made by a baby.

b. A filter 135 followed by a power detector 137—for finding spectral components of at least a predefined intensity within one or more frequency ranges—these spectral component may be indicative of a sound made by a baby.

The low power trigger sensor consumes less power than processor 14. It may not perform speed recognition or highly accurate verification of a sound made by a baby.

FIG. 3-5 illustrate that the monitor 10 may be coupled to a vehicle computer 50 and/or to one or more vehicle units 51 that may be controlled by the vehicle computer 50.

Monitor 10 may communicate, directly or indirectly, with network 30.

The vehicle units 51 may include any communication and/or computerized unit of the vehicle. For example, the vehicle units 51 may include one or more out of:

a. Lock and unlock unit 52.

b. Speaker/multimedia unit 53.

c. Ignition unit 54.

d. Window control unit 55.

e. Sensing unit 56.

f. Air conditioning unit 57.

g. Memory unit 58.

h. Communication module 59.

The monitor 10 may control each one of the vehicle units—either directly or indirectly. The monitor 10 may request the vehicle computer to control any vehicle unit in order to perform any operation related to the detection of a baby in the vehicle and/or to a baby in vehicle response.

For example—the monitor 10 may request or instruct (directly or using vehicle computer 50) window control unit 55 to open or close one or more windows.

For example—the monitor 10 may request or instruct (directly or using vehicle computer 50) air conditioning unit 57 to set the temperature of the vehicle to a desired temperature. This may include cooling the interior of the vehicle in hot days and/or heating the vehicle in freezing days.

For example—the monitor 10 may request or instruct (directly or using vehicle computer 50) speaker and/or multimedia unit 53 to generate sound regarding the presence of a baby in the vehicle.

FIG. 6 illustrates that the voice signatures 153, recorded messages 152 and contact information may be stored in a memory unit 58 of the vehicle computer 50—and may be retrieved by monitor 10.

FIG. 7 also illustrates monitor 10 as directly communicating with computerized device 33 outside the vehicle.

FIG. 8 illustrates an example of a method 100.

Method 100 may start by step 110 of constantly operating a microphone and a low power trigger sensor.

In parallel to step 110, method 100 may include a sequence of steps.

The sequence starts by step 120 of detecting, by the low power trigger sensor, a voice trigger.

Step 120 may be followed by step 130 of awakening at least a processor.

Step 130 may be followed by step 140 of searching, by the processor, for a sound of a baby crying.

If the search failed (the sound trigger is not related to a baby crying) then the processor may enter a sleep mode and step 140 is followed by step 120.

If the search succeeded (the sound trigger is related to a baby crying—especially finding a fit between the sensed sounds and previously stored voice signatures—or any other criterion is fulfilled) step 140 is followed by step 150.

Step 150 may include generating one or more messages indicative of the sensing of the baby crying. The one or more messages may be audio recordings that represent baby crying sounds that are sensed by the microphone.

A recorded message may be recorded after step 130. Alternatively, a previously recorded message may be transmitted.

Step 150 may include generating any other message (audio, video, text, audiovisual, and the like) in addition to or instead the recorded messages.

Step 150 may be followed by step 160 of transmitting the one or more messages outside the vehicle. The monitor may participate in step 160. The messages may be sent from the monitor to a communication component within the vehicle that in turn may perform the transmission outside the vehicle.

Steps 150 and 160 are examples of an execution of a baby cry response.

The method may also include shutting down any awakened components that were awakened during step 130.

It should be noted that when detecting that a baby that is left in the vehicle the monitor may send an alert and/or command and/or request to a vehicle component (or any other entity) that may trigger another operation such as unlocking the vehicle, activate hazard lights and/or generate hazard noises and/or broadcast an message such as a 'Help, there's baby in this vehicle' message, transmit (for example using vehicle telematics) an alert about the event to the owner (driver) as well as a predefined list of receivers stored in the vehicle database (or any other accessible database)—for example using GPS.

Although the mentioned above monitor sensed baby crying in the vehicle—the monitor may be configured to sense other vehicle related events such as but not limited to vehicle thefts.

For example—one or more microphones may listen and low power trigger sensor may sense a sound trigger then the processor may be awakened and may detect a breaking noise and/or detect human conversation or voice patters to discover a vehicle theft attempt.

When a theft attempts is detected the vehicle may lock or unlock itself, activate hazard lights and generate noises and broadcast messages such as 'Help, this vehicle is being jacked', in addition if the vehicle is coupled to telematics communicates—the vehicle may transmit an alert regarding the theft to the owner, insurance company, police as well as a predefined list of receivers.

The monitor may also monitor emergency events. For example, one or more microphones may be listening and low power trigger sensor may sense a trigger (operating in low power mode) and then the processor may detect SOS signals from people in the vehicle, it could be a preconfigured trigger or stress detection put hazard lights and make noise and broadcast 'Help me', in addition if vehicle is connected in addition the vehicle telematics communicates about the event to the owner, police as well as a predefined list of receivers with GPS.

In all the mentioned above cases the monitor may allow and/or may trigger another vehicle components (such as vehicle computer) to enable listening (by one or more vehicle microphone) to sounds (using one or more speaker in the vehicle) from a remote site.

FIG. 9 illustrates method 101.

Method 101 includes a step 110 and a sequence of steps 111, 112, 113, 121, 131 and 141. Step 141 may be followed by either one of steps 111 and 151—depending on the outcome of step 141.

Step 110 may be executed in parallel to steps 111-151. Step 110 may include constantly operating a microphone and a low power trigger sensor. This may be executed during one or more sensing periods.

Step 111 may include receiving by the microphone, while the processor is asleep, initial audio signals. These sound signals are terms initial because the precede the (current) awakening of the processor.

Step 112 may include converting, by the microphone, the initial audio signals to initial electrical signals representative of the initial audio signals.

Step 113 may include receiving, by the trigger sensor, the initial electrical signals representative of the initial audio signals.

The sequence starts by step 121 of detecting, by the low power trigger sensor, a voice trigger. The voice trigger is related to a sound made by a baby.

The searching of step 121 may include searching the voice trigger in the initial electrical signals.

Step 121 may be followed by step 131 of awakening at least a processor.

Step 131 may be followed by step 141 of searching, by the processor, for a sound made by a baby.

The searching of step 141 may include searching for the sound of the cry of the baby in at least one out of (a) the initial audio signals, and (b) following audio signals sensed by the microphone after the awakening of the processor.

If the search failed (the sound trigger is not related to a baby crying) then the processor may enter a sleep mode and step 141 is followed by step 111.

If the search succeeded (the sound trigger is related to a sound made by a baby—especially finding a fit between the sensed sounds and previously stored voice signatures—or any other criterion is fulfilled) step 141 is followed by step 151.

Step 151 may include performing a baby in vehicle response. This response provides an indication—especially outside the vehicle—that a baby was left in the vehicle.

Step 151 may include at least one of the following:

a. Generating one or more messages indicative of the sensing of the baby in the vehicle.
b. Generating one or more messages that are audio recordings that represent baby crying sounds (or other sounds made by the baby) that are sensed by the microphone.
c. Generating any other message (audio, video, text, audiovisual, and the like) instead or in addition to the recorded messages.
d. Transmitting the one or more messages outside the vehicle.
e. Sending an alert and/or command and/or request to a vehicle component (or any other entity) that may trigger another operation such as one or more out of: unlocking the vehicle, activate hazard lights and/or generate hazard noises and/or broadcast an message such as a 'Help, there's baby in this vehicle' message, transmit (for example using vehicle telematics) an alert about the event to the owner (driver) as well as a predefined list of receivers stored in the vehicle database (or any other accessible database)—for example using GPS.

FIG. 10 illustrates method 102.

Method 102 differs from method 100 by including steps 114, 115 and 116—the illustrates the the trigger sensor and the microphone may be activated constantly during sensing periods—and may be deactivated outside the sensing periods.

Steps 114, 115 and 116 may be included in method 100, in method 101 and the like.

A sensing period may start when the vehicle is turned off, when another event is detected, or according to a predefined schedule.

Step 114 includes determining to start a sensing period.

Step 115 may include constantly operating (during the sensing period) a microphone and a low power trigger sensor.

Step 116 may include deactivating the low power trigger sensor and the microphone after the completion of the sending period.

Step 116 may be followed by step 114.

Steps 114-116 contribute to a reduction in the power consumption of the monitor.

FIG. 11 illustrates an example of method 105.

Method 105 may start by step 110 of constantly operating a microphone and a low power trigger sensor.

In parallel to step 110, method 105 may include a sequence of steps.

The sequence starts by step 125 of detecting, by the low power trigger sensor, a voice trigger. The voice trigger is indicative of a burglary attempt. This may include sensing a breaking attempt (for example a sound of a breaking glass), sensing an attempt to ignite the vehicle without using a vehicle key, and the like. Sensing that one or more people are in the vehicle (for example—sensing speech or other noised made by people in the vehicle) after the vehicle was shut down and locked.

Step 125 may be followed by step 130 of awakening at least a processor.

Step 130 may be followed by step 145 of searching, by the processor, for a sound related to a burglary attempt.

If the search failed (the sound trigger is not related to a baby crying) then the process step 145 is followed by step 125.

If the search succeeded step 140 is followed by step 155 of executing a burglary attempt response.

The executing of the burglary attempt response may include at least one out of:

a. Locking the vehicle.
b. Unlocking the vehicle.
c. Activate hazard lights.
d. Generate noises.
e. Broadcasting messages such as 'Help, this vehicle is being jacked'.
f. Transmitting (when the vehicle is coupled to telematics) an alert regarding the theft to the owner and/or to an insurance company, and/or the police as well as a predefined list of receivers with GPS.

A method may be provided for sensing by the monitor, emergency events. For example, one or more microphones may be listening and low power trigger sensor may sense a trigger (operating in low power mode) and then the processor may detect SOS signals from people in the vehicle, it could be a preconfigured trigger or stress detection put hazard lights and make noise and broadcast 'Help me', in addition if vehicle is connected in addition the vehicle telematics communicates about the event to the owner, police as well as a predefined list of receivers with GPS Any combination of any steps of any method may be provided.

The terms "comprising", "having", "including", "consisting of" and "consisting essentially of" are used in an interchangeable manner. Any reference to any of these terms should be applicable mutatis mutandis to any other of these terms. For example—while FIG. 2 illustrates monitor 10 as including components/units 12, 13, 14, 15, 16 and 19—monitor 10 may include additional components/units, may include only these components/unit or may include substantially only these components/units.

Furthermore, those skilled in the art will recognize that boundaries between the functionality of the above described operations are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Thus, it is to be understood that the architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

However, other modifications, variations, and alternatives are also possible. The specifications and drawings are, accordingly, to be regarded in an illustrative rather than in a restrictive sense.

The word "comprising" does not exclude the presence of other elements or steps then those listed in a claim. It is understood that the terms so used are interchangeable under appropriate circumstances such that the embodiments of the invention described herein are, for example, capable of operation in other orientations than those illustrated or otherwise described herein.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe.

Thus, these terms are not necessarily intended to indicate temporal or other prioritization of such elements. The mere fact that certain measures are recited in mutually different claims does not indicate that a combination of these measures cannot be used to advantage.

We claim:

1. A method for monitoring, the method comprises:

constantly operating, within one or more sensing periods, a microphone and a trigger sensor of a monitor that is installed in a vehicle, even when a processor of the monitor is asleep; wherein a power consumption of the trigger sensor is lower than a power consumption of the processor when the processor is awake;

receiving by the microphone, while the processor is asleep, initial audio signals;

converting, by the microphone, the initial audio signals to initial electrical signals representative of the initial audio signals;

receiving, by the trigger sensor, the initial electrical signals representative of the initial audio signals;

searching, by the trigger sensor and in the initial electrical signals, for a voice trigger that is related to a sound made by a baby;

when finding the voice trigger then awakening the processor;

searching, by the processor, for the sound made by the baby in at least one out of (a) the initial audio signals, and (b) following audio signals sensed by the microphone after the awakening of the processor;

when finding the sound made by the baby then executing a baby in vehicle response.

2. The method according to claim 1 wherein the preforming of the baby in vehicle response comprises generating and transmitting outside of the vehicle one or more messages indicative of the sensing the sound made by the baby.

3. The method according to claim 2 when at least one of the one or more messages comprises an audio recording of the sound made by the baby that was sensed by the microphone.

4. The method according to claim 2 when at least one of the one or more messages comprises an audio recording of the sound made by the baby that was sensed by the microphone after the awakening of the processor.

5. The method according to claim 2 when at least one of the one or more messages comprises an audio recording of the sound made by the baby that was sensed by the microphone, starting before the awakening of the processor.

6. The method according to claim 2 comprising storing or retrieving contact information for contacting a computerized device located outside the vehicle, and sending at least one of the one or more messages using the contact information.

7. The method according to claim 2 comprising sending at least one of the one or more messages using a predefined list of receivers that is stored in a vehicle database.

8. The method according to claim 2 comprising retrieving from a vehicle system, contact information for contacting a computerized device located outside the vehicle, and requesting a communication component of the vehicle to send at least one of the one or more messages using the contact information.

9. The method according to claim 1 wherein the preforming of the baby in vehicle response comprises playing, by a speaker, an audio recording of the sound made by the baby that was sensed by the microphone.

10. The method according to claim 1 wherein the preforming of the baby in vehicle response comprises instructing or requesting, by the processor, a speaker of the vehicle to play an audio recording of the sound made by the baby that was sensed by the microphone.

11. The method according to claim 1 comprising putting to sleep the processor when failing to find the sound sound made by the baby.

12. The method according to claim 1 wherein the preforming of the baby in vehicle response comprises unlocking the vehicle.

13. The method according to claim 1 wherein the preforming of the baby in vehicle response comprises performing at least one out of activating hazard lights of the vehicle and generating generate hazard noises by the vehicle.

14. The method according to claim 1 wherein the preforming of the baby in vehicle response comprises broadcasting a baby in vehicle message.

15. The method according to claim 1 wherein at least one sensing period of the one or more sensing periods overlap a shut down period of the vehicle during which the vehicle is shut down.

16. The method according to claim 1 wherein at least one sensing period of the one or more sensing periods overlap a turn on period of the vehicle during which the vehicle is turned on.

17. The method according to claim 1 comprising receiving, by the monitor and from a vehicle computer status information about a status of the vehicle; and determining, based on the status of the vehicle, whether to start a sensing period of the one or more sensing periods.

18. The method according to claim 1 comprising searching, by the trigger sensor and in the initial electrical signals, for another voice trigger that is related to a burglary attempt;

when finding the other voice trigger then awakening the processor;

searching, by the processor, for a sound that is related to the burglary attempt in at least one out of the initial audio signals, and the following audio signals;

when finding the sound that is related to the burglary attempt then performing a burglary attempt response.

19. The method according to claim 18 wherein the burglary attempt response comprises locking the vehicle when finding.

20. The method according to claim 18 wherein the burglary attempt response comprises generating and transmitting outside of the vehicle one or more messages indicative of the burglary attempt.

21. A non-transitory computer readable medium that stores instructions that once executed by a monitor that is installed in a vehicle, cause the monitor to execute the steps of:

constantly operating, within one or more sensing periods, a microphone and a trigger sensor of the monitor, even when a processor of the monitor is asleep; wherein a power consumption of the trigger sensor is lower than a power consumption of the processor when other processor is awake;

receiving by the microphone, while the processor is asleep, initial audio signals;

converting, by the microphone, the initial audio signals to initial electrical signals representative of the initial audio signals;

receiving, by the trigger sensor, the initial electrical signals representative of the initial audio signals;

searching, by the trigger sensor and in the initial electrical signals, for a voice trigger that is related to a sound made by a baby;

when finding the voice trigger then awakening the processor;

searching, by the processor, for the sound made by the baby in at least one out of (a) the initial audio signals, and (b) following audio signals sensed by the microphone after the awakening of the processor; and when finding the sound made by the baby then executing a baby in vehicle response.

22. A monitor that comprises a processor, a microphone and a trigger sensor;

wherein the microphone and the trigger sensor are configured to constantly operate, within one or more sensing periods, even when the processor of the monitor is asleep; wherein a power consumption of the trigger sensor is lower than a power consumption of the processor when other processor is awake;

wherein the microphone is configured to (i) receive, while the processor is asleep, initial audio signals; and (ii) convert the initial audio signals to initial electrical signals representative of the initial audio signals;

wherein the trigger sensor is configured to (i) receive the initial electrical signals representative of the initial audio signals; (ii) search in the initial electrical signals, for a voice trigger that is related to a sound made by a baby; and (iii) participate in awakening the processor when finding the voice trigger;

wherein the processor is configured to (i) search for the sound made by the baby in at least one out of (a) the initial audio signals, and (b) following audio signals sensed by the microphone after the awakening of the processor; and (ii) assist in executing a baby in vehicle response, when finding the sound of the cry of the baby.

* * * * *